US006904767B1

(12) United States Patent
Wright

(10) Patent No.: US 6,904,767 B1
(45) Date of Patent: Jun. 14, 2005

(54) SYSTEM FOR THE DEHUMIFICATION OF AIR

(75) Inventor: William G. Wright, Odessa, FL (US)

(73) Assignee: John J. Sheridan & Associates, Inc., Odessa, FL (US)

( * ) Notice: Subject to any disclaimer, the term of this patent is extended or adjusted under 35 U.S.C. 154(b) by 60 days.

(21) Appl. No.: 10/800,570

(22) Filed: Mar. 15, 2004

(51) Int. Cl.[7] ..... F25D 17/06
(52) U.S. Cl. ..... 62/427; 62/428
(58) Field of Search ..... 62/427, 426, 428, 62/314, 434, 172, 277, 414, 419

(56) References Cited

U.S. PATENT DOCUMENTS 5,239,834 A * 8/1993 Travers ..... 62/151
5,275,233 A * 1/1994 Little ..... 165/111
5,467,615 A * 11/1995 Bolton et al. ..... 62/498
5,607,011 A * 3/1997 Abdelmalek ..... 165/104.14
5,651,258 A * 7/1997 Harris ..... 62/90
5,806,444 A * 9/1998 Figueras et al. ..... 110/346
5,822,991 A * 10/1998 Pierzchala et al. ..... 60/653
5,826,443 A * 10/1998 Ares et al. ..... 62/324.1
6,094,835 A * 8/2000 Cromer ..... 34/80
6,131,653 A * 10/2000 Larsson ..... 165/228
6,199,388 B1 * 3/2001 Fischer, Jr. ..... 62/90
6,408,633 B1 * 6/2002 Carr ..... 62/99
6,578,629 B1 * 6/2003 Trent ..... 165/274

FOREIGN PATENT DOCUMENTS

JP 10267414 A * 10/1998
JP 2002277045 A * 9/2002

* cited by examiner

*Primary Examiner*—William E. Tapolcai
*Assistant Examiner*—Mohammad M. Ali
(74) *Attorney, Agent, or Firm*—Dennis G. LaPointe; Mason Law, P.L.

(57) ABSTRACT

An improved air conditioner system for controlling a desired temperature and a reduced humidity level in a space to be environmentally controlled, that comprises an additional second heat exchanger in the separate indoor air flow path. The refrigerant circuit includes an anti-migration control device between the compressor and the second heat exchanger. An anti-floodback control device is located upstream of the compressor between the first heat exchanger in the indoor air path and the compressor. An expansion control device is also located in the refrigerant circuit between the heat exchanger in the outdoor air flow path and the heat exchanger in the indoor air flow path. The second heat exchanger effectively becomes a hot gas re-heat de-superheater heat exchanger. The system enhances the latent capacity for providing dehumidified air of from 25–40 percent.

7 Claims, 3 Drawing Sheets

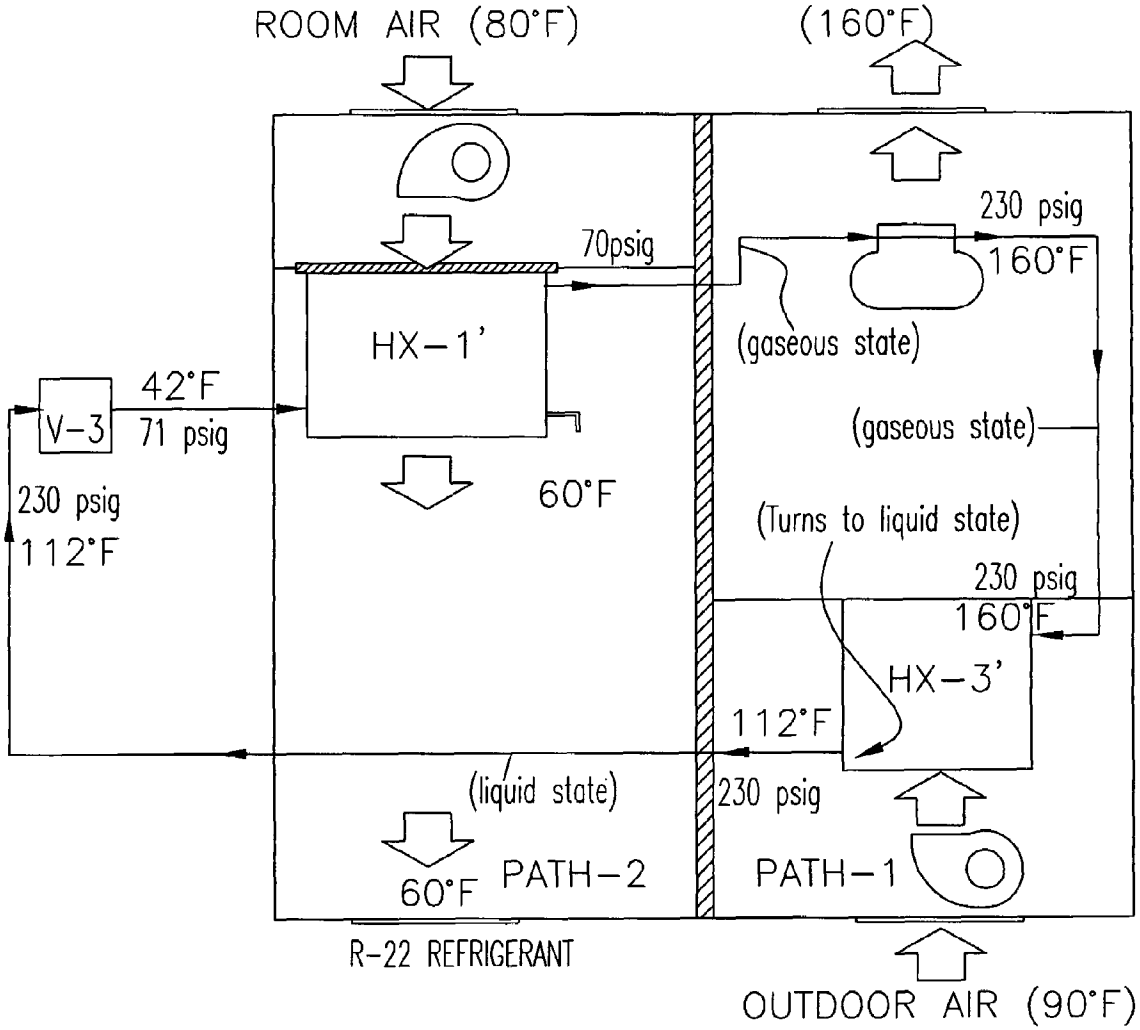
PRIOR ART Fig.3

SYSTEM FOR THE DEHUMIFICATION OF AIR

FIELD OF THE INVENTION

The invention relates to a refrigerant cooling assembly and more particularly, pertains to the drying of air using a cooling coil that condenses moisture from the air directed through the cooling coil.

BACKGROUND OF THE INVENTION

The use of air conditioners is known in the prior art. More specifically, air conditioners heretofore devised and utilized for the purpose of processing cooled air are known to consist of familiar, expected and obvious structural configurations, notwithstanding the myriad of designs encompassed by the prior art, which have been developed for the fulfillment of countless objectives and requirements.

In this respect, the cooling assembly according to the present invention substantially departs from the conventional prior art concepts and designs, and in doing so, provides an apparatus primarily for the purpose of drying air by removing more moisture from the air than other air conditioners.

It is an object of the present invention to provide an improvement, which overcomes inadequacies of the prior art devices and provides an improvement, which is a significant contribution to the advancement of the prior art.

Another object of the invention is to provide re-heat to the dryer and cooler air leaving the apparatus.

SUMMARY OF THE INVENTION

For the purpose of summarizing this invention, this invention is comprised of conduits or chambers for use in directing air and conditioning the flows of air or fluids using a wide variety of heat generation, cooling, variation of pressure or vacuum, and the effect of this to remove moisture, particles and some gases from an air stream that is conditioned for a specified use.

The present invention includes an air path for cooling and drying air, including air return means through which air is directed from a residential or commercial space requiring cooled and dehumidified air. This can be an air inlet and an air handling blower/fan unit downstream of the air inlet interfacing with the space being cooled and dehumidified. An air filter means for filtering return air is disposed inwardly or downstream of the air return means.

The filtered air passes across a first heat exchanger, typically finned-tube that has a lower surface temperature than the returned air being directed across it. This air transfers heat to the refrigerant within the heat exchanger. Further, moisture is created on the heat exchanger surface, as a result of condensation, which is drained away to the environment.

Because the invention produces refrigerant at a lower temperature than other units, the cooled and dehumidified air passes through a hot gas re-heat de-superheater heat exchanger (second heat exchanger). The system provides additional sub-cooling of from 18–25° F. of the refrigerant, which enhances the latent capacity as much as 25–40 percent. This processed air exits through the discharge path of the invention directly into the residential or commercial space requiring the controlled temperature and humidity level.

The foregoing has outlined rather broadly the more pertinent and important features of the present invention in order that the more detailed description of the invention that follows can be better understood and so that the significant contribution to the state of the art can be more fully appreciated. Further, in view of the disadvantages inherent in the known types of air conditioners now present in the prior art, the present invention provides an improved cooling assembly, especially for humid environment locations worldwide.

BRIEF DESCRIPTION OF THE DRAWING

In the accompanying drawing:

FIG. 3 is a schematic representation of a corresponding prior art system showing examples of representative temperatures of the air as well as pressures and temperatures of the refrigerant in the refrigerant circuit.

DETAILED DESCRIPTION OF THE INVENTION

Figure 1:
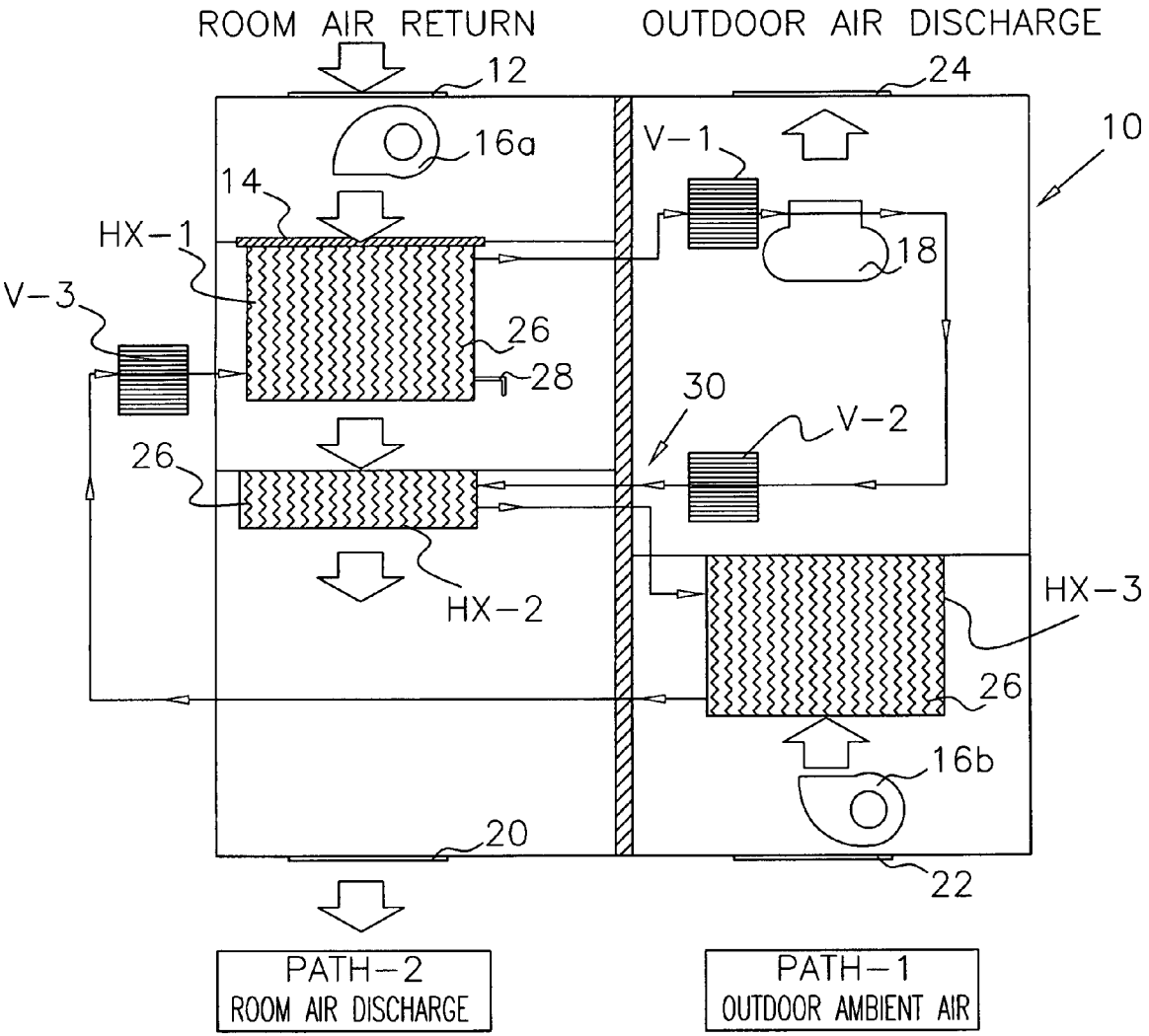
FIG. 1 is a conceptual schematic representation of the present invention in one generic embodiment of an air conditioner, showing various heat exchangers and control and protective devices that illustrate the invention and the basic flow of refrigerant and air flows.

Referring now to the drawing, FIG. 1 depicts a conceptual schematic representation of the present invention, which is an improved air conditioning system for the dehumidification of air, depicted generally as 10.

FIG. 1 provides an example of main components of an air conditioner system that incorporates the present inventive improvement, which includes the hot gas re-heat de-superheater heat exchanger air flow processing stage of the room air being processed in Path-2.

FIG. 1 depicts an air conditioning/dehumidification assembly in the true sense. Path-2 shows room air entering the apparatus at 12 passing through a filter means 14 to remove particulate matter for most applications. Filter means 14 can come in a variety of configurations, including means for filtering odors and killing bacteria. Some of these filter means 14 include U-V light technology or chlorine gas technology. High-efficiency particulate (HEPA) filters to standard air or furnace type filters are also included within what is contemplated by such filter means 14. As defined in this disclosure, all such filtering means are contemplated.

After the room air passing through the air return inlet 12 is directed with air flow means 16*a* (such as a fan or other type of blower air handler, including squirrel cage fans and centrifugal blowers) through the filter means 14, the air then passes through a first heat exchanger (HX-1), typically a finned-tube heat exchanger (evaporator coils), which has a lower surface temperature than that provided standard air conditioners known in the art.

Figure 2:
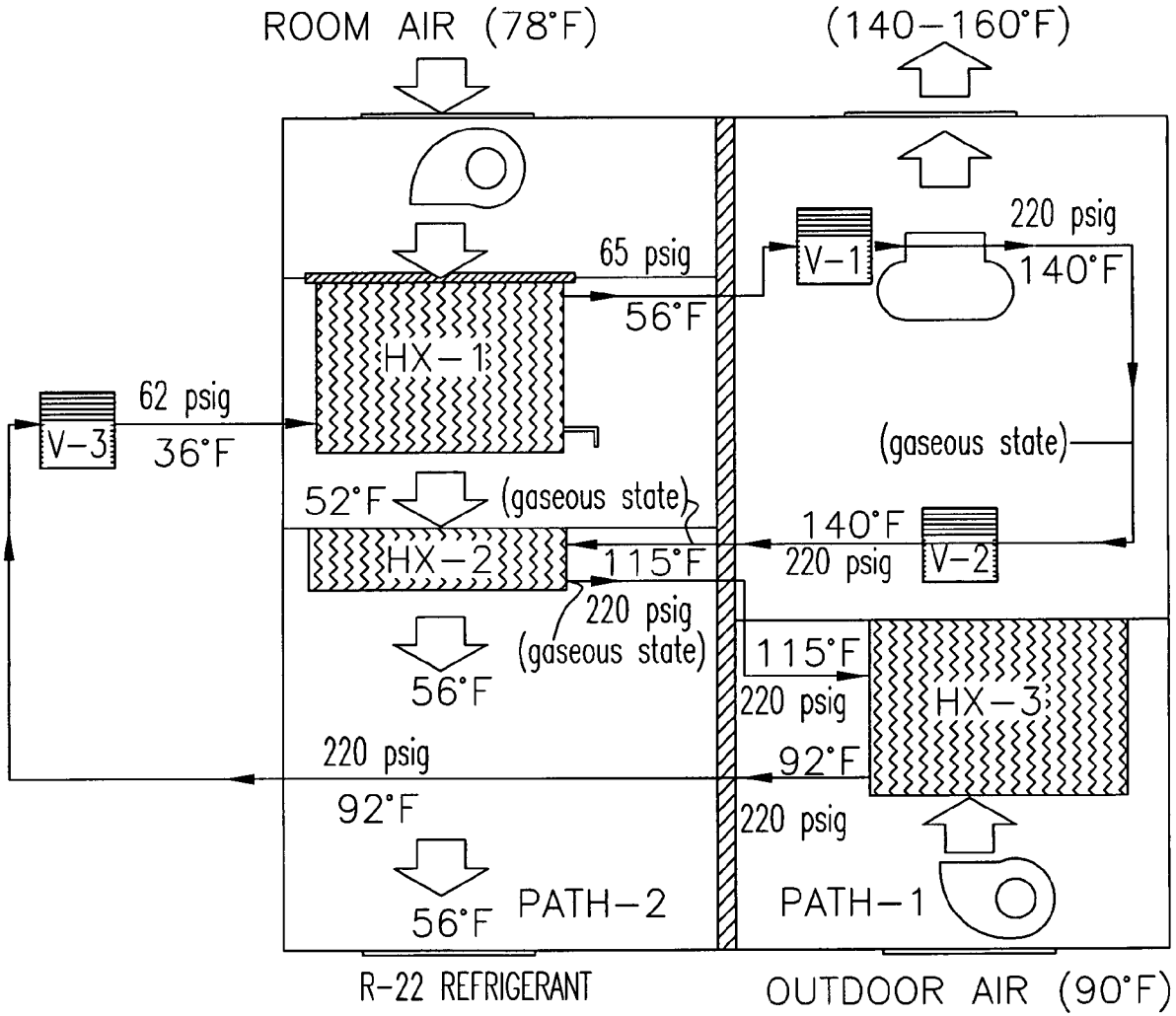
FIG. 2 is a schematic representation of an example of representative temperature and line pressures in the refrigerant circuit and temperatures of the air at various flow stages in the present invention.

The standard air conditioner provides surface temperatures from 42° F. to 62° F. with the room air entering at 78° F. to 80° F. and leaving the coil at 58–60° F. (see FIG. 3). The present invention applied to a standard air conditioner provides surface temperatures from 36–56° F. with room air entering at 78–80° F. and leaving the coil at 52–54° F. This cooler air then passes across reheat de-super heater and is heated from 52–54° F. to 56–58° F. This reheat is necessary to raise the temperature of the cooler discharge air (see FIG. 2).

This condition causes significant additional amounts of moisture to collect on the surface of this heat exchanger HX-1 by the condensation process. This moisture is typically drained away from the system as conceptually shown by drain fitting 28. In actuality, it could encompass a drain pan and associated tubes or conduit lines to direct the condensed moisture away from the system and to the outside environment. The cooled and dehumidified air passes across a second heat exchanger (HX-2), which transfers heat, thereby raising the temperature of the colder air. That is, heat exchanger HX-2 comprises a hot gas reheat coiled system. The heat is transferred to the air from the high temperature refrigerant leaving the motor/compressor 18 (hereinafter, the compressor portion of the combination motor and compressor will also be referred to as 18). This discharging air continues to exit the apparatus through air distribution devices, ducts, grilles and other means, collectively referred to herein as room air inlet means 20 for distributing the dehumidified air back into the residential or commercial space.

The refrigerant, upon leaving heat exchanger (HX-2), enters a third heat exchanger (HX-3) at close to the condensing temperature, thus providing an almost immediate change of state of gas to liquid. This condition causes significant sub-cooling of the liquid refrigerant leaving heat exchanger (HX-3), which is a condenser sub-cooling coil (or tube) system, and the liquid refrigerant is at a reduced discharge pressure entering an expansion device V-3. This expansion control device V-3 is designed to reduce the pressure of the liquid refrigerant to a specified or desired pressure, with a corresponding cooler temperature of refrigerant liquid. The liquid state of the refrigerant is changed back to a gaseous state by absorbing heat from the air passing across heat exchanger (HX-1).

Path-1, as shown in FIG. 1, is illustrative of the outside air or atmospheric outdoor ambient air flow through a separated air flow path of the improved inventive air conditioner system 10. In this flow path, outside ambient air is directed with air flow means (such as a fan or other type of blower air handler, including squirrel cage blowers and centrifugal fans) through outdoor ambient air inlet 22 across the third heat exchanger (HX-3), typically a finned-tube heat exchanger, and then discharging back into the atmosphere at 22. The air flow means 16*b* in the outside air flow Path-1 and the air flow means 16*a* in the room air flow Path-2 may incorporate common components. For example, a single motor but dual shaft fan system could be used. Fan blades could be used or squirrel cage or centrifugal fans could be used in higher flow capacity systems. As stated above, the refrigerant enters heat exchanger (HX-3), having lost most of the heat of compression from the compressor 18 and rapidly changes state from a super-heated gas to a liquid. Significant sub-cooling occurs (18–25° F.) and this sub-cooled liquid refrigerant passes to expansion device V-3. Because the pressure within heat exchanger (HX-3) is considerably lower than in standard units the pressure of the sub-cooled liquid entering heat exchanger (HX-1) is lower, thus providing a corresponding cooler temperature.

With the present invention, the pressure of the refrigerant within heat exchanger HX-3 is 220 psig, while the pressure of the refrigerant within heat exchanger HX-3' of FIG. 3 for the standard air conditioner is 230 psig. The expansion control device V-3 for the present invention is designed to introduce liquid state refrigerant at 62 psig, which has a corresponding saturated suction temperature of 36° F. The standard air conditioner expansion control device V-3' is designed to introduce liquid refrigerant at 71 psig, which has a saturation temperature of about 42° F.

All temperatures and pressures noted above and in FIGS. 2 and 3 are proximate amounts and do not reflect minor pressure drops in the refrigerant circuit due to piping losses, fitting losses, etc. Further, it should be noted that R-22 refrigerant is used in the example of FIG. 2 as well as in the comparative prior art schematic of FIG. 3. Other refrigerants known in the art could be used and it is anticipated that the invention will incorporate future commercially available refrigerants under development.

As shown in Path-1 of FIG. 1, anti-floodback control device V-1 is a device located upstream of the compressor 18, which serves as means for protecting the compressor 18 from liquid refrigerant that might occur during low ambient operation and/or low load conditions of the system 10. Anti-migration control device V-2 is a device located downstream of the compressor 18, which serves as means for protecting the compressor 18 from liquid refrigerant that might migrate from heat exchanger (HX-3) and heat exchanger (HX-2) during off cycles of the system 10. Although anti-floodback control device V-1 and anti-migration control device V-2 are shown in the chamber portion that substantially comprises flow Path-1, they could also be located in the air chamber portion that substantially comprised flow Path-2.

The present invention 10 is contemplated to be used in a variety of air conditioner configurations where the chamber/duct system in which the room air circulates (Path-2) is separate and distinct from the chamber/duct system in which the ambient outdoor air circulates (Path-1). In fact, the chamber/duct systems need not even be adjacent to each other. The improved air conditioner system 10 could be applied to roof-top mounted residential and commercial units, window or wall mounted units, and units where one component is mounted adjacent a structure outside and the other component is remotely mounted inside the structure.

It should be understood that the preceding is merely a detailed description of one or more embodiments of this invention and that numerous changes to the disclosed embodiments can be made in accordance with the disclosure herein without departing from the spirit and scope of the invention. Further, it should also be appreciated by those skilled in the art that the conception and any specific embodiment disclosed might be readily utilized as a basis for modifying or designing other structures for carrying out the same purposes of the present invention. The preceding description, therefore, is not meant to limit the scope of the invention. Rather, the scope of the invention is to be determined only by the appended claims and their equivalents.

What is claimed is:

1. An improved air conditioner system for controlling a desired temperature and a reduced humidity level in a space to be environmentally controlled, the air conditioner system comprising:

a first air flow path through which, outside ambient air flows;

a second air flow path for processing air from a space to be environmentally controlled back to the space;

said first air flow path being separate from said second air flow;

refrigerant circuit means for circulating a refrigerant fluid through heat exchangers in the first and second air flow paths, the refrigerant circuit means including a compressor;

the first air flow path comprising an ambient outdoor air inlet means in air flow communication with forced air flow means for directing the flow of outdoor ambient air through the first air flow path and for discharging said ambient outdoor air through ambient outdoor air discharge means;

heat exchanger means for transferring heat from the refrigerant fluid being circulated inside tubing comprising said heat exchanger means, to said ambient outdoor air passing through said heat exchanger means over said tubing;

the second air flow path comprising a room air return inlet means in air flow communication with forced air flow means for directing the flow of room air returning from the space to be environmentally controlled, through the second air flow path, and back to said space through room air inlet means for discharging the flow of air exiting the second air flow path;

first heat exchanger means for transferring heat from the room air to the refrigerant fluid being circulated inside tubing comprising said first heat exchanger means, thereby cooling and dehumidifying said room air that has passed through a filter means;

second heat exchanger means, downstream of the first heat exchanger means, for transferring heat from the circulating refrigerant fluid inside tubing comprising said second heat exchanger means, said refrigerant fluid being at a raised temperature after exiting the compressor, the heat being transferred to the room air exiting the first heat exchanger means; and the refrigerant circuit means further comprising:

anti-floodback control means for protecting the compressor from liquid refrigerant that may occur during low ambient temperature operation or under low load condition operation of the improved air conditioner system, said anti-floodback control means being located upstream of the compressor;

anti-migration control means for protecting the compressor from liquid refrigerant that may migrate from the tubing in said heat exchanger means in the first air flow path or from the tubing in said second heat exchanger means in said second air flow path, said anti-migration control means being located downstream of the compressor; and expansion means for reducing a pressure of a liquid state refrigerant fluid leaving tubing in said heat exchanger means in the first air flow path to a desired pressure with a resultant corresponding cooler temperature of the refrigerant fluid so as to change the refrigerant fluid back to a gaseous state for entry into the tubing in the first heat exchanger means in the second air flow path, said expansion means being located upstream of the first heat exchanger means and downstream of the heat exchanger means in the first air flow path, wherein the refrigerant fluid circulates from the compressor through the anti-migration control means, through the tubing in the second heat exchanger means in the second air flow path, through the tubing in the heat exchanger means in the first air flow path, through the expansion means, through the tubing in the first heat exchanger means in the second air flow path, through the anti-floodback control means and back to the compressor to complete the refrigerant circuit means.

2. The improved air conditioner system according to claim 1, wherein the refrigerant, upon leaving the second heat exchanger means enters the heat exchanger means in the first air flow path at an approximate condensing temperature and provides a change of state of the refrigerant from a gaseous state to a liquid state, causing a substantial sub-cooling of liquid refrigerant leaving the heat exchanger means in the first air flow path, wherein the liquid refrigerant is at the reduced desired discharge pressure entering the expansion means, wherein with the corresponding cooler temperature of refrigerant liquid, the liquid state of the refrigerant is changed back to a gaseous state by absorbing heat from the air passing across the first heat exchanger means in the second air flow path, and wherein a latent dehumification capacity of the improved air conditioner system is enhanced by 25–40 percent.

3. The improved air conditioner system according to claim 1, further comprising filter means for particulate removal from the room air returning from the space entering through said room air return inlet means.

4. The improved air conditioner system according to claim 1, wherein the use of the second heat exchanger means in the second air flow path and the associated tubing containing the circulating refrigerant fluid of the refrigerant circuit means within the second heat exchanger means, and the anti-migration control means serves as means for further reducing a surface temperature of the tubes within the first heat exchanger means thereby creating additional amounts of moisture to collect on the surface of the first heat exchanger means and to be drained away from the system.

5. The improved air conditioner system according to claim 4, further comprising condensate drain means for removing the moisture accumulating on the tubes of the first heat exchanger means.

6. The improved air conditioner system according to claim 4, wherein the second heat exchanger means in the second air flow path is a hot gas re-heat de-superheater heat exchanger.

7. The improved air conditioner system according to claim 1, wherein the refrigerant fluid flowing from the second heat exchanger means in the second air flow path to the heat exchanger means in the first air flow path enters said heat exchanger in the first air flow path at close to a condensing temperature of the refrigerant fluid to provide an immediate change of state of the refrigerant fluid from a gaseous state to a liquid state, thereby causing a substantial sub-cooling of the liquid state refrigerant fluid leaving the heat exchanger means in the first air flow path.

* * * * *